US005709620A

United States Patent [19]

Reinprecht

[11] Patent Number: 5,709,620

[45] Date of Patent: Jan. 20, 1998

[54] SPORT COURT TRAINING TARGET ASSEMBLY

[76] Inventor: Christine K. Reinprecht, 1616 Stonington Cir., North Wales, Pa. 19454

[21] Appl. No.: 820,043

[22] Filed: Mar. 19, 1997

Related U.S. Application Data

[60] Provisional application No. 60/014,198, Mar. 27, 1996.

[51] Int. Cl.[6] ..... A63B 69/38

[52] U.S. Cl. ..... 473/459; 434/247

[58] Field of Search ..... 473/459; 434/247

[56] References Cited

U.S. PATENT DOCUMENTS

| | | | |
|---|---|---|---|
| D. 255,822 | 7/1980 | Dulude | D22/15 |
| 4,743,020 | 5/1988 | Meurer . | |
| 4,842,283 | 6/1989 | LeBel et al. . | |
| 4,948,372 | 8/1990 | Stotland | 473/459 X |
| 5,002,284 | 3/1991 | Butler et al. | 372/342 |
| 5,083,774 | 1/1992 | Yalvac . | |
| 5,201,526 | 4/1993 | Ketcham, Jr. . | |
| 5,348,291 | 9/1994 | Scully . | |
| 5,435,560 | 7/1995 | Kehoe . | |
| 5,452,902 | 9/1995 | Foster et al. . | |

FOREIGN PATENT DOCUMENTS

4117374 A1 12/1992 Germany .

*Primary Examiner*—William H. Grieb
*Attorney, Agent, or Firm*—Richard C. Litman

[57] ABSTRACT

An assembly for assisting in the instruction of court or playing-field games, e.g., tennis, the assembly having two-dimensional panels that are strategically positioned on a court. Each panel is made of a flexible, durable material that forms a plane for positioning and repositioning on the surface of a tennis court, thus permitting a tennis instructor to customize tennis lessons according to the specific needs, strengths, or weaknesses of a particular student player. For instance, when instructing a young child, the targeting devices can be moved to a forward position on the court in order to reduce difficulty and assure the positive feedback essential in teaching children. Each targeting panel may have weights attached to the lower surface of the panel to assure positioning in windy weather, or when the panel is repeatedly struck with tennis balls. With minor modification, the target assembly may be used as a training aid in volleyball, soccer, squash, badminton, paddle tennis, hockey, etc.

19 Claims, 2 Drawing Sheets

SPORT COURT TRAINING TARGET ASSEMBLY

CROSS-REFERENCE TO RELATED APPLICATION

This application claims the benefit of U.S. Provisional patent application Ser. No. 60/014,198, filed Mar. 27, 1996.

BACKGROUND OF THE INVENTION

1. Field of the Invention

This invention relates to sport court targets for training purposes and, in particular, to a tennis targeting device with multiple targeting panels for assisting a professional tennis instructor in teaching tennis, for example. Each targeting panel is strategically located on a tennis court to maximize the instructive benefits of the targets. The targets are planar panels made of a flexible, durable sheet material. Upon the upper surfaces of the panels are indicia for indicating placement on the court and also for determining a player's accuracy.

2. Description of the Prior Art

The prior art is replete with sports targeting devices purporting to aid in skill development. U.S. Design Pat. No. 255,822 issued on Jul. 8, 1980, to Dulude shows a pattern for a gun target, but does not teach how to make or use a device that is intended primarily to assist in the instruction of tennis. Though U.S. Pat. No. 4,743,020 issued on May 10, 1988, to Meurer is a utility patent, it describes an apparatus that lacks flexibility of use. The Meurer patent describes a large, upright structure intended to enhance a ball player's aim, whether in tennis, squash, or handball; however, it cannot be adapted to simulate conditions of an actual tennis game.

Several patents describe inventions intended to improve player skill for a particular game, such as U.S. Pat. No. 4,842,283 issued on Jun. 27, 1989, to LeBel et al., that describes a targeting assembly that simulates an ice hockey net. Similarly, U.S. Pat. No. 5,083,774 issued on Jan. 28, 1992, to Yalvac describes a baseball target assembly. Additionally, U.S. Pat. No. 5,348,291 issued on Sep. 20, 1994, to Scully shows a baseball pitching trainer, which includes numerous weighted plumb lines that are displaced by a pitched ball, thereby indicating the accuracy of the throw. Finally, of conceptual interest is U.S. Pat. No. 5,435,560 issued on Jul. 25, 1995, to Kehoe, which describes a golf putting target that simulates a golf hole. This device describes a putting target made of a thin, pliable, disk for placement on a surface. None of the aforementioned targeting devices can be adapted for use on a court during a tennis match or drill session in conjunction with a instruction session by a professional tennis instructor.

Other patents describe games. For example, U.S. Pat. No. 5,000,284 issued on Mar. 26, 1991, to Butler et al. describes an indoor balloon bounce game with a small rectangular playing mat that resembles a ping-pong table, which is placed on the floor of a game room. This game cannot be adapted to instruct tennis. Describing still another game, U.S. Pat. No. 5,201,526 issued on Apr. 13, 1993, to Ketcham, Jr., resembles lawn croquet, except the goal is a small trampoline-like assembly that rests several inches off the surface of a lawn. Finally, U.S. Pat. No. 5,452,902 issued on Sep. 26, 1995, to Forster et al., describes a ball game wherein the ball and the puck/targets are covered with hook and loop material. These games, while assisting young players develop motor skills and coordination, cannot be adapted to simulate a tennis match or assist a tennis instructor.

Finally, German Offenlegungsschrift 41 17 374 A 1, published on May 28, 1991, by Zimmer describes a complex electronic signaling device including a target mat that permits self instruction. Aside from the complexity and expense of this device, it provides a singularity of utility that cannot simulate actual court conditions during a match. French Brevet D'Invention, Pub. No. 2,706,779, published on Dec. 30, 1994, by Sournies describes a netted training cage for tennis and other sports with an inclined tube that returns the ball to the player. Like the German publication this publication describes a device that precludes on-court drill sessions initiated by, and including, the professional tennis instructor.

Consequently, the inventions of the prior art lack the spontaneity and immediacy that allow the student of tennis to learn at a varied rate. Furthermore, inventions of the prior art lack the flexibility that permit the instructor to customize lessons according to the level of the student. None of the above inventions and patents, taken either singly or in combination, is seen to describe the instant invention as claimed. Therefore, a need exists for a sport court training targeting device solving the aforementioned problems.

SUMMARY OF THE INVENTION

The present invention is a sport court training targeting device for assisting in the instruction of court sports, and made up of five, two-dimensional targeting panels that are strategically placed on a tennis court. Each targeting panel is preferably made of a flexible durable sheet material, such 40 oz-/yard$^2$ PVC-coated nylon fabric. Each targeting panel has an upper surface and lower surface. Each targeting panel can be positioned and repositioned on a tennis court, with the lower surface of the targeting panel disposed contiguously with the surface of the tennis court. Further, each targeting panel may contain a plurality of weights, such as zinc washers, inserted into small pockets formed by stitching (or some other manner of sealing) tabs of a material similar to that which forms the targeting panels, to the lower surface of each of the targeting panels.

More specifically, the sport court training target panels are as follows. Three targeting panels are a similarly formed D-shape. Each of these three targeting panels has alignment indicia thereon for facilitating placement and alignment of the target panel on the court. The alignment indicia replicates the line formed by either the service line or the midline. The other two targeting panels are mirror images, each having two linear edges that meet to form approximately a right angle and a third edge forming an arc. Further, upon each of the five targeting panels are geometrically shaded target zones that assist the student or the instructor determine accuracy of a serve, volley or shot. Once the targeting panels have been placed on the side of the court opposite the player, the instructor can take his or her position alongside the targeting panels and begin the serving or the drill lessons.

Importantly, while using the present invention, the instructor may customize lessons according to the specific needs, strengths, or weaknesses of a particular player simply by rearranging the position of the targeting panels on the court. For instance, when instructing a beginner such as a young child, the targeting panels can be moved to a forward position on the court to minimize difficulty and to maximize the fun, amusement and positive feedback essential in successfully teaching children. For the intermediate player, the instructor can use the sport court training targets to help develop ground strokes, volleys and serves. And finally, for the advanced player, the instructor can position the sport court training targets for creating difficult patterned drills, to mimic match scenarios, and develop playing strategies against the mimicked match scenarios.

Accordingly, it is a principal object of the invention to provide a two-dimensional targeting device, having five panels, that plays a fundamental role, and is an essential tool in the professional tennis instructor's repertoire of instruction methods. Further, it is an essential feature of the present invention that the targeting panels provide the instructor with a tool that is both flexible and adaptable in its use and practical application.

It is another object of the invention to provide the professional tennis instructor with a method of teaching tennis lessons that is easily adaptable and flexible to the needs and skill levels of individual players and, moreover, provides the instructor and player with immediate feedback and reinforcement.

It is another object of the invention to provide indicia on the surface of target panels that are geometrically shaped target zones.

Still another object of the invention is to provide two-dimensional sport court training targeting panels that are inexpensive .and made of materials that are flexible, durable and readily available. Further, it is intended that the sport court training targets require little or no post-purchase assembly. The sport court training targets are readily removed from a tennis court after a drill session and then completely and compactly stored.

In a broader context, it is an object of the invention to provide a sport court training assemblage of targets for assisting in striking or throwing a ball or object to a specific location; the invention may be used as a training device in squash, soccer, paddle tennis, badminton, volleyball, etc., to name but a few additional sports.

It is an object of the invention to provide improved elements and arrangements thereof in an apparatus for the purposes described which is safe, inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
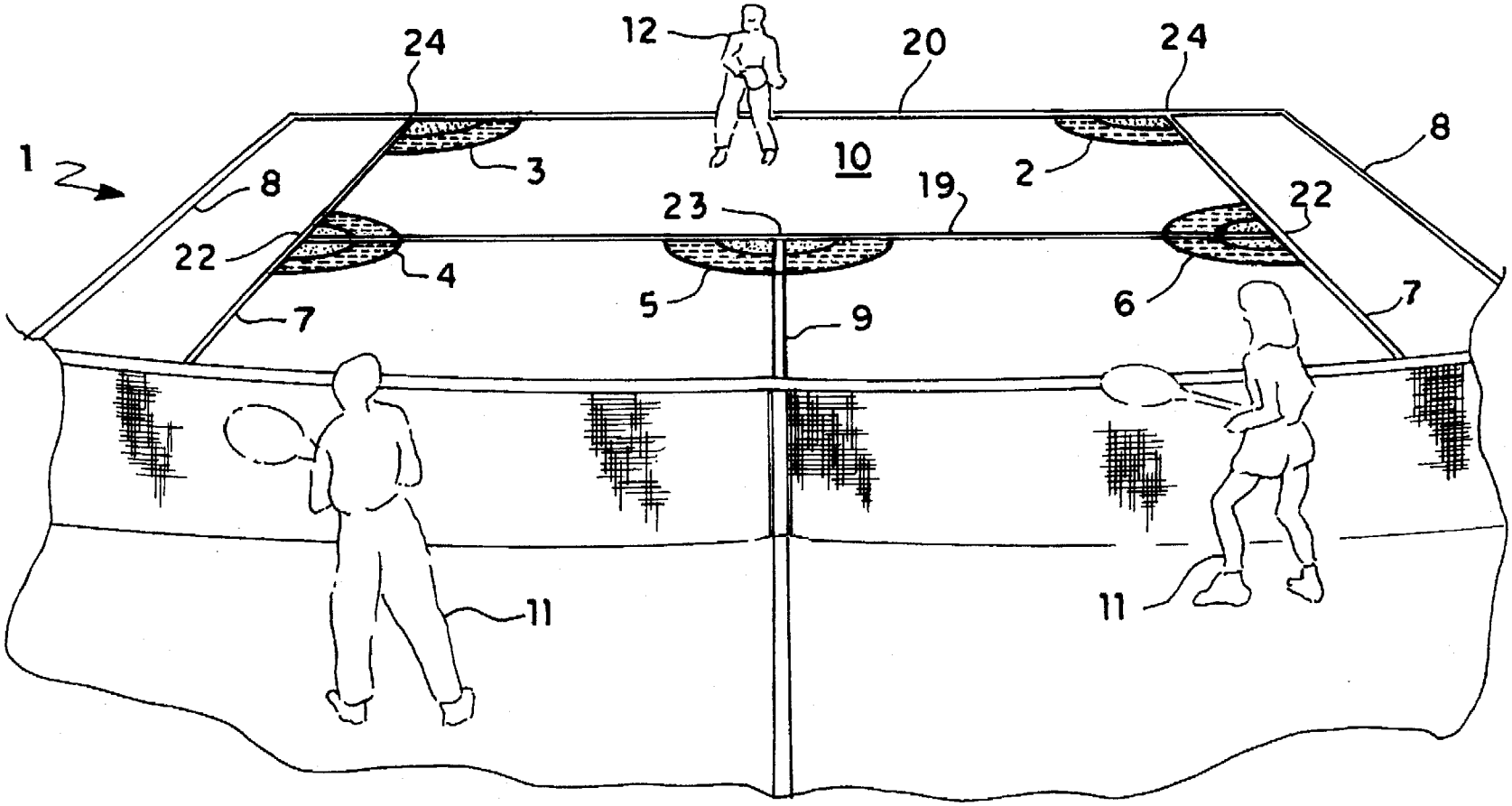
FIG. 1 is an environmental perspective view of a tennis court showing the placement of the five targeting panels of the sport court training target assembly on a tennis court during a drill session for doubles, with the instructor rearcourt and the students forecourt.
Figure 2:
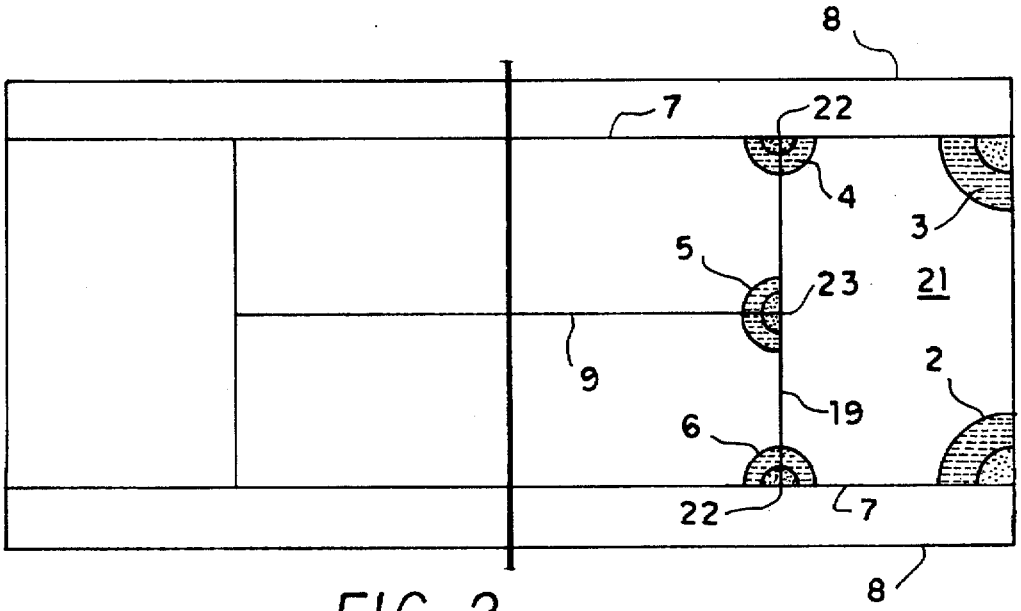
FIG. 2 is a plan view of a tennis court showing the placement of the five targeting panels of the sport court training target assembly.
Figure 3:
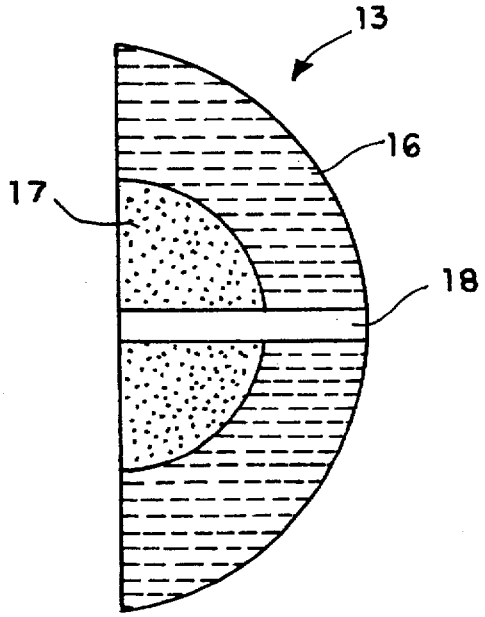
FIG. 3 is a plan view of one of the D-shaped service targeting panels of the sport court training target assembly.

The present invention is a two-dimensional sport court training targeting device 1, FIG. 1, which includes five targeting panels 2,3,4,5,6 (best seen in FIG. 2). In the preferred embodiment, three of the targeting panels 4,5,6 function as service targets 13 and are D-shaped, as shown in FIG. 3. In the preferred embodiment, the other two targeting panels 2,3 function as baseline targets 14, shown in FIG. 4. Each of the baseline targeting panels has two linear edges 26,26 that meet to form approximately a right angle 27 and a third edge that forms an arc 28, which is preferably a radial arc. Each of the five targeting panels has an upper and lower surface. On the upper surfaces of the panels are geometrically shaped indicia 16 and 17, 36 and 37, respectively, that indicate target zones (best appreciated in FIGS. 3 and 4). The outer indicia 16,36 represent a target for a well placed shot, whereas the inner indicia 17,37 represent a target for an ideal shot.

One fundamental difficulty with such panels 2,3,4,5,6, is maintaining their position on the sport court (i.e., tennis court). It is preferable to simply form the panels 2,3,4,5,6 from a flexible and durable, heavy-weight fabric which has an intrinsic weight that provides adequate stability for the panels while they remain on the court. One such heavy-weight fabric is a PVC coated nylon fabric having a weight of approximately 40 ounces per square yard.(available from Seaman Corporation, Wooster, Ohio). Use of the heavy-weight fabric is desirable and preferred because the fabric provides a uniform surface that allows balls which strike the panels to bounce true (i.e., with an expected trajectory and response). An alternative method for maintaining the position of the panels is to utilize additional weights in conjunction with a light-weight film or fabric. Such weights (not shown) or other weighting means (i.e., sand, etc.) may be placed within pockets (not shown) formed in .the lower surface of each panel, within a bead formed along the edge of each panel, or elsewhere on the panels. While the use of such weights has proven to be effective in maintaining the position of the panels 2,3,4,5,6 in windy weather or when the panels are struck repeatedly with tennis balls, the weights cause balls which strike the panels to hop or skip with an unexpected trajectory.

FIG. 3 shows both alignment and target zone indicia of the three D-shaped service targeting panels 13. A linear shaped area of uniform shading 18, which facilitates alignment and placement of the D-shaped service targeting panels 13 on either a portion of the service line 19, or a portion of the midline 9 on a tennis or similar sport court (shown in FIG. 2). Also on the upper surface of the D-shaped service targeting panels 13 are two geometrically shaped regions 16,17 each of uniform shading for indicating a targeting zone.

Figure 4:
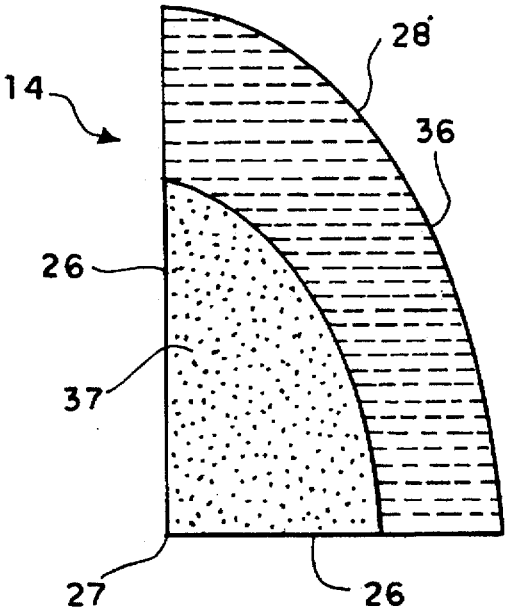
FIG. 4 is a plan view of one the two baseline panels.

FIG. 4 shows the target zone indicia on the baseline targeting panels 14. On the upper surface of the baseline targeting panels are two geometrically shaped regions 36,37, each of uniform shading for indicating a targeting zone.

FIGS. 1 and 2 show the preferred method of placement of the five targeting panels 2,3,4,5,6 of the tennis target assembly on a court. A baseline targeting panel 3 and another complementary baseline targeting panel 2 are placed at the intersections 24,24 of the baseline 20 with the singles service lines 7,7 (or on the doubles sidelines 8,8). The D-shaped service targeting panels 4,5,6 are placed at the following locations: 1) the intersection 23 of the midline 9 with the service line 19; and 2) at the intersections 22,22, of the singles sidelines 7,7 (or on the doubles sidelines 8,8) with the service line 19. FIG. 1 shows the players 11 on the court during a drill session with the instructor 12 in the backcourt 10.

By now, it is readily appreciated that the teachings of the instant invention may be applied to virtually any sport having a court or like playing surface, where it is desirable to develop the skill of striking or throwing a ball or other object to a specific location; e.g., soccer, racquetball squash, badminton, volleyball, paddle tennis, etc.

It is to be understood that the present invention is not limited to the embodiments described above, but encompasses any and all embodiments within the scope of the following claims.

I claim:

1. A sport court training target assembly for assisting in the instruction of a sport having a court or like playing surface, comprising:

a first targeting panel constructed of a sheet material, said first panel having an upper surface, a lower surface and at least two edges, one of said at least two edges being linear, and there being target indicia on said first panel upper surface, said first panel being disposed for positioning with said lower surface on a sport court at a "T"-type intersection of two lines on the sport court; and a second targeting panel constructed of said sheet material, said second panel having an upper surface, a lower surface and at least three edges, including a first edge and a second edge which are linear and meet to form a substantially right angle, and there being target indicia on said second panel upper surface, said second panel being disposed for positioning with said lower surface on a sport court at a right angle intersection of two lines on the sport court.

2. The sport court training target assembly according to claim 1, wherein said first panel includes alignment indicia on said first panel upper surface for alignment of said first panel at the "T"-type intersection of two lines on the sport court.

3. The sport court training target assembly according to claim 1, wherein said first panel is D-shaped.

4. The sport court training target assembly according to claim 1, wherein said second panel includes a third edge having a radial arc.

5. The sport court training target assembly according to claim 1, wherein said sheet material is a heavy-weight fabric.

6. The sport court training target assembly according to claim 5, wherein said heavy-weight fabric has a weight of approximately 40 ounces per square yard.

7. The sport court training target assembly according to claim 5, wherein said heavy-weight fabric is a PVC-coated nylon fabric.

8. The sport court training target assembly according to claim 1, comprising at least three of said first panels.

9. The sport court training target assembly according to claim 8, comprising at least two of said second panels.

10. The sport court training target assembly according to claim 1, comprising at least two of said first panels.

11. A method of teaching tennis comprising at least two of the following steps:

strategically positioning and repositioning before and during a tennis lesson in order to maximize educational feedback and reinforcement, a first targeting panel constructed of a sheet material, the first panel having an upper surface, a lower surface and at least two edges, one of the at least two edges being linear, and there being target indicia on the first panel upper surface and alignment indicia on the first panel upper surface, the first panel being disposed for positioning upon a tennis court near the intersection of the service line with the midline;

strategically positioning and repositioning before and during a tennis lesson in order to maximize educational feedback and reinforcement, a second targeting panel constructed of a sheet material, the second panel having an upper surface, a lower surface and at least two edges, one of the at least two edges being linear, and there being target indicia on the second panel upper surface and alignment indicia on the second panel upper surface, the second panel being disposed for positioning upon the tennis court near the intersection of the service line with a first sideline;

strategically positioning and repositioning before and during a tennis lesson in order to maximize educational feedback and reinforcement, a third targeting panel constructed of a sheet material, the third panel having an upper surface, a lower surface and at least two edges, one of the at least two edges being linear, and there being target indicia on the third panel upper surface and alignment indicia on the third panel upper surface, the third panel being disposed for positioning upon the tennis court near the intersection of the service line with a second sideline;

strategically positioning and repositioning before and during a tennis lesson in order to maximize educational feedback and reinforcement, a fourth targeting panel constructed of a sheet material, the fourth panel having an upper surface, a lower surface and at least three edges, including a first edge and a second edge which are linear and meet to form a substantially right angle, and there being target indicia on the fourth panel upper surface, the fourth panel being disposed for positioning upon the tennis court near the intersection of the first sideline with the baseline; and strategically positioning and repositioning before and during a tennis lesson in order to maximize educational feedback and reinforcement, a fifth targeting panel constructed of a sheet material, the fifth panel having an upper surface, a lower surface and at least three edges, including a first edge and a second edge which are linear and meet to form a substantially right angle, and there being target indicia on the fifth panel upper surface, the fifth panel being disposed for positioning upon the tennis court near the intersection of a second sideline with the baseline.

12. A method of teaching tennis as recited in claim 11, wherein at least three of the five steps are accomplished.

13. A method of teaching tennis as recited in claim 11, wherein at least four of the five steps are accomplished.

14. A method of teaching tennis as recited in claim 11, wherein all five of the five steps are accomplished.

15. A method of teaching tennis as recited in claim 14, wherein the strategic positioning steps are accomplished by locating the first panel, the second panel, the third panel, the fourth panel, and the fifth panel on any surface of the tennis court in a predetermined fashion, in order to achieve maximum instructional benefit.

16. A sport court training target assembly for assisting in the instruction of a game requiring the use of a court-type playing surface and accurate striking or throwing of a ball or object to one or more specific target areas of the playing surface, the sport court training target assembly comprising:

a first generally D-shaped targeting panel constructed of a sheet material, said first panel having an upper surface, a lower surface and at least two edges, one of said at least two edges being linear, and there being target indicia on said first panel upper surface and alignment indicia on said first panel upper surface, said first panel being disposed for positioning with said lower surface on a sport court at a "T"-type intersection of two lines on the sport court;

a second generally D-shaped targeting panel constructed of said sheet material, said second panel having an upper surface, a lower surface and at least two edges, one of said at least two edges being linear, and there being target indicia on said second panel upper surface and alignment indicia on said second panel upper surface, said second panel being disposed for positioning with said lower surface on the sport court at a "T"-type intersection of two lines on the sport court;

a third generally D-shaped targeting panel constructed of said sheet material, said second panel having an upper surface, a lower surface and at least two edges, one of said at least two edges being linear, and there being target indicia on said second panel upper surface and alignment indicia on said second panel upper surface, said second panel being disposed for positioning with said lower surface on the sport court at a "T"-type intersection of two lines on the sport court;

a fourth targeting panel constructed of said sheet material, said fourth panel having an upper surface, a lower surface and at least three edges, including a first edge and a second edge which are linear and meet to form a substantially right angle, and there being target indicia on said fourth panel upper surface, said fourth panel being disposed for positioning with said lower surface on the sport court at a right angle intersection of two lines on the sport court; and a fifth targeting panel constructed of said sheet material, said fifth panel having an upper surface, a lower surface and at least three edges, including a first edge and a second edge which are linear and meet to form a substantially right angle, and there being target indicia on said fifth panel upper surface, said fifth panel being disposed for positioning with said lower surface on the sport court at a right angle intersection of two lines on the sport court.

17. The sport court training target assembly according to claim 16, wherein said sheet material is a heavy-weight fabric.

18. The sport court training target assembly according to claim 17, wherein said heavy-weight fabric has a weight of approximately 40 ounces per square yard.

19. The sport court training target assembly according to claim 17, wherein said heavy-weight fabric is a PVC-coated nylon fabric.

* * * * *